US008658338B2

(12) United States Patent
Horiba et al.

(10) Patent No.: US 8,658,338 B2
(45) Date of Patent: Feb. 25, 2014

(54) TONER, LIQUID DEVELOPER, DRY DEVELOPER, DEVELOPER CARTRIDGE, PROCESS CARTRIDGE, IMAGE FORMING APPARATUS, AND IMAGE FORMING METHOD

(75) Inventors: Koji Horiba, Kanagawa (JP); Takahiro Ishizuka, Kanagawa (JP); Yoshihiro Inaba, Kanagawa (JP); Akira Imai, Kanagawa (JP); Ryosaku Igarashi, Kanagawa (JP); Takako Kobayashi, Kanagawa (JP); Daisuke Yoshino, Kanagawa (JP); Masahiro Oki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 18 days.

(21) Appl. No.: 13/588,529

(22) Filed: Aug. 17, 2012

(65) Prior Publication Data

US 2013/0216943 A1 Aug. 22, 2013

(30) Foreign Application Priority Data

Feb. 17, 2012 (JP) ..... 2012-032836

(51) Int. Cl.
*G03G 9/00* (2006.01)

(52) U.S. Cl.
USPC ..... 430/105; 430/109.1; 430/114; 430/117.5; 430/124.1

(58) Field of Classification Search
USPC ..... 430/105, 109.1, 114, 117.5, 124.1
See application file for complete search history.

(56) References Cited

U.S. PATENT DOCUMENTS

2005/0064312 A1* 3/2005 Mikuriya et al. ..... 430/109.1
2005/0069801 A1* 3/2005 Yamasaki et al. ..... 430/110.2

* cited by examiner

*Primary Examiner* — Hoa V Le
(74) *Attorney, Agent, or Firm* — Oliff PLC

(57) ABSTRACT

A toner includes a resin having an unsaturated double bond, a thiol compound having a bi- or more-functional thiol group, and a polymerization initiator.

13 Claims, 1 Drawing Sheet

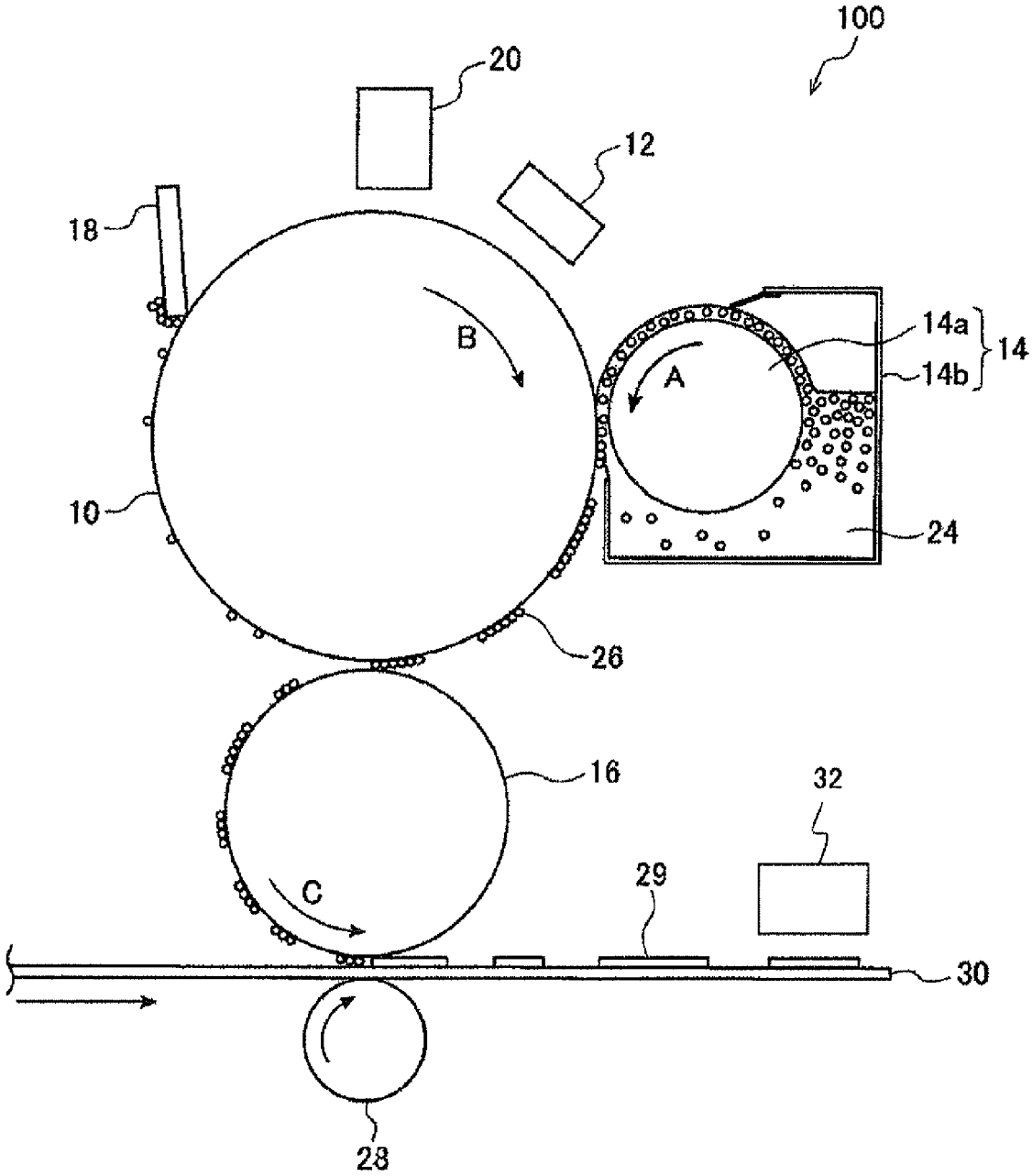
100
20
12
18
B
14a
14
14b
A
10
24
26
16
32
29
C
30
28

TONER, LIQUID DEVELOPER, DRY DEVELOPER, DEVELOPER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-032836 filed Feb. 17, 2012.

BACKGROUND

1. Technical Field

The present invention relates to a toner, a liquid developer, a dry developer, a developer cartridge, a process cartridge, an image forming apparatus, and an image forming method.

2. Related Art

A method such as electrophotography, in which image information is visualized through an electrostatic charge image, is currently being used in various fields. In electrophotography, a latent image (an electrostatic latent image) is formed on an image holding member through charging and exposure processes (latent image forming process); the electrostatic latent image is developed using an electrostatic charge image developer (hereinafter, sometimes, simply referred to as a "developer") containing a toner for developing an electrostatic charge image (hereinafter, sometimes, simply referred to as "toner") (developing process); and the developed image is visualized through transfer and fixing processes. As developers for dry development, there are two-component developers including toner and a carrier and single-component developer including a magnetic or non-magnetic toner only.

On the other hand, a liquid developer for wet development is obtained by dispersing toner particles in an insulating carrier solution and, for example, a type in which toner particles containing a thermoplastic resin are dispersed in a volatile carrier solution and a type in which toner particles containing a thermoplastic resin are dispersed in a refractory carrier solution are known.

SUMMARY

According to an aspect of the invention, there is provided a toner including a resin having an unsaturated double bond, a thiol compound having a bi- or more-functional thiol group, and a polymerization initiator.

BRIEF DESCRIPTION OF THE DRAWINGS

Exemplary embodiments of the present invention will be described in detail based on the following FIGURE, wherein:

FIG. 1 is a diagram schematically illustrating a configuration example of an image forming apparatus according to an exemplary embodiment of the invention.

DETAILED DESCRIPTION

Hereinafter, an exemplary embodiment of the invention will be described. The exemplary embodiment is merely an example implementing the invention and does not limit the invention.

Toner

A toner according to the exemplary embodiment includes a resin having an unsaturated double bond, a thiol compound having a bi- or more-functional thiol group, and a polymerization initiator. In the exemplary embodiment, it is considered that, by using a resin having an unsaturated double bond, a thiol compound having a bi- or more-functional thiol group, and a polymerization initiator, after an image is formed, the unsaturated double bond of the resin having an unsaturated double bond and the thiol group of the thiol compound with low oxygen inhibition are polymerized by heat, light, or the like for curing; and as a result, even in the atmosphere, an image is sufficiently cured and an image with satisfactory blocking resistance is obtained. Using an ene-thiol reaction, an image has less curing shrinkage and is sufficiently cured in the atmosphere.

The resin having an unsaturated double bond is not particularly limited, and examples thereof include a styrene-butadiene block copolymer, natural rubber, and synthetic rubber such as isoprene rubber or chloroprene rubber which have an unsaturated double bond. Among these, a styrene-butadiene block copolymer is preferable from the viewpoints of UV reactivity and the like.

The weight average molecular weight of the resin having an unsaturated double bond is preferably from 5,000 to 300,000. When the weight average molecular weight of the resin having an unsaturated double bond is less than 5,000, blocking resistance may deteriorate due to insufficient curing, and when the weight average molecular weight is greater than 300,000, insufficient fixing may occur.

The content of the resin having an unsaturated double bond in the toner is not particularly limited, and for example, is from 5% by weight to 50% by weight with respect to the total weight of the toner. When the content of the resin having an unsaturated double bond in the toner is less than 5% by weight, insufficient curing may occur, and when the content of the resin having an unsaturated double bond in the toner is greater than 50% by weight, insufficient fixing may occur.

The thiol compound having a bi- or more-functional thiol group is not particularly limited and examples thereof include thiol compounds such as pentaerythritol tetrakis(3-mercaptobutylate), 1,3,5-tris(3-mercaptobutyloxyethyl), 1,3,5-triazine-2,4,6-(1H,3H,5H)-trione, 1,4-bis(3-mercaptobutyryloxy)butane, trimethylolpropanetris(3-mercaptobutyrate), and trimethylolethanetris(3-mercaptobutyrate) (all of which are manufactured by SHOWA DENKO K.K.). Among these, pentaerythritol tetrakis(3-mercaptobutylate) is preferable from the viewpoints of less bad odor and the like. With regard to the number of functional groups of the thiol compound, three or more functional groups are preferable and four or more functional groups are more preferable, from the viewpoints of curability and the like.

The content of the thiol compound in the toner is not particularly limited, and for example, is from 2% by weight to 20% by weight with respect to the total weight of the toner. When the content of the thiol compound in the toner is less than 2% by weight, insufficient curing may occur, and when the content of the thiol compound in the toner is greater than 20% by weight, blocking resistance may deteriorate due to unreacted thiol.

The polymerization initiator is not particularly limited and examples thereof include a photopolymerization initiator and a thermal polymerization initiator. From the viewpoints of preservability and the like, the photopolymerization initiator is preferable. The photopolymerization initiator and the thermal polymerization initiator may be used together. When they are used together, there is, for example, an advantage that even the inside of toner may be cured. Preferable examples of the photopolymerization initiator include IRGACURE 184, IRGACURE 819, IRGACURE 907, IRGACURE 369, and IRGACURE 1173 (all of which are manufactured by BASF Japan Ltd.). IRGACURE 819 is preferable from the viewpoints of curability and the like. Preferable examples of the thermal polymerization initiator include azo compounds such as V-59 (2,2'-azobis isobutyronitrile), V-70, V-65, V-601, and VF-096 (all of which are manufactured by Wako Pure Chemical Industries, Ltd.); and organic peroxides such as benzoyl peroxide. From the viewpoints of impact, thermal stability, and the like, V-601 is preferable.

The content of the polymerization initiator in the toner is not particularly limited, and for example, is from 1% by weight to 10% by weight with respect to the total weight of the toner. When the content of the polymerization initiator in the toner is less than 1% by weight, insufficient curing may occur, and when the content of the polymerization initiator in the toner is greater than 10% by weight, insufficient curing may occur.

It is preferable that the toner according to the exemplary embodiment include a vinyl resin. It is considered that when the toner includes the vinyl resin, the glass transition temperature of the resin increases; and as a result, an image with superior blocking resistance is obtained. The vinyl resin is not particularly limited and examples thereof include styrene resin, styrene-acrylic resin, and rubber. From the viewpoints of heat resistance and the like, styrene-acrylic resin is preferable.

The weight average molecular weight of the vinyl resin is preferably from 10,000 to 500,000. When the weight average molecular weight of the vinyl resin is less than 10,000, blocking resistance may deteriorate due to a low glass transition temperature, and when the weight average molecular weight of the vinyl resin is greater than 500,000, insufficient fixing may occur.

The content of the vinyl resin in the toner is not particularly limited, and for example, is from 20% by weight to 80% by weight with respect to the total weight of the toner. When the content of the vinyl resin in the toner is less than 20% by weight, blocking resistance may deteriorate, and when the content of the vinyl resin in the toner is greater than 80% by weight, insufficient curing may occur.

It is preferable that the toner according to the exemplary embodiment further include a radical polymerizable material. It is considered that when the toner includes the radical polymerizable material, curing reactivity is improved; and as a result, an image with superior blocking resistance is obtained. The radical polymerizable material is not particularly limited, and examples thereof include M211B (EO-modified bisphenol A diacrylate), M-305 (pentaerythritol triacrylate and pentaerythritol tetraacrylate), M-402 (dipentaerythritol pentaacrylate and dipentaerythritol hexaacrylate), and M-320 (PO-modified trimethylolpropane triacrylate) (all of which are manufactured by TOAGOSEI CO., LTD.). From the viewpoints of blocking resistance and the like, M211B (EO-modified bisphenol A diacrylate) is preferable.

The content of the radical polymerizable material in the toner is not particularly limited, and for example, is from 1% by weight to 10% by weight with respect to the total weight of the toner. When the content of the radical polymerizable material in the toner is less than 1% by weight, only a portion is cured and thus insufficient curing may occur, and when the content of the radical polymerizable material in the toner is greater than 10% by weight, an unreacted radical polymerizable material remains to a large degree and thus blocking resistance may deteriorate.

Hereinafter, other components of the toner according to the exemplary embodiment will be described in detail.

The toner according to the exemplary embodiment includes a binder resin and optionally may further include other components such as a colorant and a release agent.

Binder Resin

The binder resin is not particularly limited and examples thereof include polyester, polystyrene, styrene-acrylic resin such as a styrene-alkyl acrylate copolymer or a styrene-alkyl methacrylate copolymer, a styrene-acrylonitrile copolymer, a styrene-butadiene copolymer, a styrene-maleic anhydride copolymer, polyethylene, and polypropylene. Furthermore, other examples thereof include polyurethane, epoxy resin, silicone resin, polyamide, modified rosin, and paraffin wax. As the binder resin, the above-described resins may be used alone or in combination of two or more kinds. In a configuration in which two or more kinds of resins are mixed and used, for example, a mixture of a thermoplastic resin and a thermoplastic elastomer is used. Specifically, a mixture of a styrene-based thermoplastic resin and a styrene-based thermoplastic elastomer such as a mixture of a styrene-acrylic resin and a styrene-based thermoplastic elastomer, may be used.

The styrene-based thermoplastic resin is a thermoplastic resin having a repeating unit derived from a monomer having a styrene structure (hereinafter, sometimes referred to as "the styrene monomer"). In this case, "the repeating unit derived from the styrene monomer" represents a repeating unit, which is obtained by a reaction with the styrene monomer, among repeating units constituting a polymer. The same shall be applied to repeating units derived from other monomers.

Examples of the styrene monomer include styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-dodecylstyrene, p-methoxystyrene, p-phenylstyrene, p-chlorostyrene, and 3,4-dichlorostyrene.

In addition, the styrene-based thermoplastic resin may be a copolymer of the styrene monomer and other monomers. Examples of other monomers include a monomer having an acrylic acid ester structure (hereinafter, sometimes referred to as "the acrylic acid ester monomer") and an other monomer having vinyl groups (hereinafter, sometimes referred to as "the vinyl monomer").

Specific examples of the acrylic acid ester monomer include alkyl esters of (meth)acrylic acid such as methyl (meth)acrylate, ethyl (meth)acrylate, propyl (meth)acrylate, n-butyl (meth)acrylate, isobutyl (meth)acrylate, n-octyl (meth)acrylate, dodecyl (meth)acrylate, 2-ethylhexyl acrylate, and stearyl (meth)acrylate; 2-chloroethyl acrylate; phenyl (meth)acrylate; α-chloroacrylic acid methyl ester; 2-hydroxy ethyl (meth)acrylate; 2-hydroxy propyl (meth) acrylate; 2-hydroxy butyl (meth)acrylate; glycidyl(meth) acrylate; dimethylaminoethyl methacrylate; diethylaminoethyl methacrylate; bis-glycidyl methacrylate; polyethylene glycol dimethacrylate; and methacryloxyethyl phosphate. These monomer examples may be used alone or in combination of two or more kinds. In this case, "(meth)acryl" represents any one of "acryl" and "methacryl" or both of them.

Examples of other vinyl monomers include olefin monomers such as ethylene, propylene, butylene, butadiene, and isoprene; vinyl ester monomers such as vinyl formate, vinyl acetate, vinyl propionate, and vinyl benzoate; acrylic acids such as acrylic acid, methacrylic acid, α-ethyl-acrylic acid, and crotonic acid, α-alkyl derivatives thereof, and β-alkyl derivatives thereof; unsaturated dicarboxylic acids such as fumaric acid, maleic acid, citraconic acid, and itaconic acid, monoester derivatives thereof, and diester derivatives thereof; mono(meth)acryloyloxyethyl succinate; (meth)acryloynitrile; acrylamide.

The weight average molecular weight (Mw) of the thermoplastic resin is, for example, from 150,000 to 500,000. In addition, the molecular weight distribution of the thermoplastic resin (Mw/Mn) is, for example, from 2 to 20. In addition, the thermoplastic resin may have plural peaks and shoulder portions in the molecular weight distribution measured by gel permeation chromatography (GPC).

The above-described weight average molecular weight (Mw) is measured by gel permeation chromatography (GPC). In the molecular weight measurement using GPC, GPC HLC-8120 (manufactured by TOSOH CORPORATION) is used as a measurement instrument, TSKgel Super HM-M (manufactured by TOSOH CORPORATION, 15 cm) is used as a column, and THF is used as a solvent. The above-described weight average molecular weight is calculated using a molecular weight calibration curve which is prepared from monodisperse polystyrene standard samples on the basis of the measurement results. Hereinafter, the weight average molecular weights are measured in the same manner. In addition, the number average molecular weight (Mn) is measured in the same manner as that of the weight average molecular weight (Mw). The molecular weight distribution (Mw/Mn) is calculated based on these values.

The content of the styrene-based thermoplastic resin in the toner is preferably from 50% by weight to 95% by weight and more preferably from 60% by weight to 90% by weight with respect to the total weight of the binder resin, from the viewpoints of crushability and the like.

The styrene-based thermoplastic elastomer resin is a thermoplastic resin having a repeating unit derived from at least the styrene monomer. Examples of the thermoplastic elastomer resin include resins which have rubber characteristics at an ordinary temperature of, for example, 25° C. and have the same softening characteristics as those of thermoplastics at high temperature.

Specific examples of the styrene-based thermoplastic elastomer resin include block copolymers of the styrene monomers and the olefin monomers. More specific examples thereof include polystyrene-polybutadiene-polystyrene, polystyrene-polybutadiene/butylene-polystyrene, polystyrene-polyethylene/butylene-polystyrene, polystyrene-polyisoprene-polystyrene, polystyrene-hydrogenated polybutadiene-polystyrene, polystyrene-hydrogenated polyisoprene-polystyrene, polystyrene-hydrogenated poly(isoprene/butadiene)-polystyrene.

In the more specific examples, for example, "polystyrene-polybutadiene/butylene-polystyrene" represents a block copolymer obtained by bonding a block of polystyrene, a block of polybutadiene, and a block of polystyrene in this order, in which the block of butadiene is partially hydrogenated. That is, "polybutadiene/butylene" represents a block where a butadiene unit and a butylene unit with hydrogenated butadiene coexist. In addition, in the more specific examples, for example, "hydrogenated polybutadiene" represents polybutadiene in which hydrogen is added to a double bond thereof.

In addition, in these block copolymers, a polar group may be introduced into a soft segment portion between polystyrenes. Examples of the polar group include a hydroxyl group, a carboxyl group, an amino group, and an acyl group.

The weight average molecular weight Mw of the styrene-based thermoplastic elastomer resin is, for example, 30,000 to 300,000.

Examples of commercial products of the styrene-based thermoplastic elastomer resin include TUFTEC M1911, TUFTEC M1943, TUFTEC MP10, ASAPRENE T439, TUFPRENE A (all of which are manufactured by Asahi Kasei Chemicals Corporation), and DYNARON 8630P (manufactured by KURARAY CO., LTD.).

When the binder resin is the mixture of the thermoplastic resin and the thermoplastic elastomer resin, the content of the thermoplastic resin is, for example, from 50% by weight to 90% by weight with respect to the total weight of the toner, and may be from 50% by weight to 70% by weight. In addition, the content of the thermoplastic elastomer resin is, for example, from 5% by weight to 50% by weight with respect to the total weight of the toner, and may be from 10% by weight to 40% by weight.

Optionally, the toner according to the exemplary embodiment may include other additives such as a colorant, a release agent, a charge-controlling agent, silica powder, a metal oxide. These additives may be internally added by, for example, kneading the additives into a binder resin or may be externally added by, for example, obtaining toner particles first and mixing the additives with the toner particles. In general, the colorant is included, but when a transparent toner is desired, the colorant may not be included.

The colorant is not particularly limited and well-known pigments or dyes may be used. Specifically, the following respective pigments of yellow, magenta, cyan, and black are used.

Representative examples of the yellow pigments include condensed azo compounds, isoindolinone compounds, anthraquinone compounds, azo metal complex compounds, methine compounds, and allylamide compounds.

Examples of the magenta pigments include condensed azo compounds, diketo-pyrrolo-pyrrole compounds, anthraquinone compounds, quinacridone compounds, basic dye lake compounds, naphthol compounds, benzimidazolone compounds, thioindigo compounds, and perylene compounds.

Examples of the cyan pigments include copper phthalocyanine compounds and derivatives thereof, anthraquinone compounds, and basic dye lake compounds.

Examples of the black pigments include carbon black, aniline black, acetylene black, and iron black.

The release agent is not particularly limited, and examples thereof include plant waxes such as carnauba wax, vegetable wax, and rice bran wax; animal waxes such as honey wax, insect wax, whale wax, and wool wax; montan wax; mineral wax such as ozokerite; Fischer-Tropsch wax (FT wax) having ester in the side chain; solid waxes of synthetic fatty acid esters such as special fatty acid ester and polyol ester; and synthetic waxes such as paraffin wax, polyethylene wax, polypropylene wax, polytetrafluoroethylene wax; polyamide wax, and silicone compound. As the release agent, the above examples may be used alone or in combination of two or more kinds.

The charge-controlling agent is not particularly limited and well-known charge-controlling agents are used. Examples thereof include positive charge-controlling agents such as nigrosine dyes, fatty acid-modified nigrosine dyes, carboxyl group-containing fatty acid modified nigrosine dyes, quaternary ammonium salts, amine compounds, amide compounds, imide compounds, and organic metal compounds; and negative charge-controlling agents such as metal complexes of oxycarboxylic acid, metal complexes of azo compounds, metal complex salt dyes, and salicylic acid derivatives. As the charge-controlling agent, the above examples may be used alone or in combination of two or more kinds.

The metal oxide is not particularly limited, and examples thereof include titanium oxide, aluminum oxide, magnesium oxide, zinc oxide, strontium titanate, barium titanate, magnesium titanate, and calcium titanate. As the metal oxide, the above examples may be used alone or in combination of two or more kinds.

Preparation Method of Toner

A preparation method of the toner according to the exemplary embodiment is not particularly limited and for example, the toner may be prepared using a pulverizing method or an emulsifying-in-liquid-and-drying method. In addition, for example, a toner prepared in the pulverizing method or in the emulsifying-in-liquid-and-drying method may be pulverized in a carrier solution.

Specifically, there are dry methods and wet methods. Examples of dry methods include a kneading and pulverizing method in which a binder resin, and optionally, a colorant, and a release agent, a charge-controlling agent and the like are kneaded, pulverized, and classified; and a method in which the shapes of particles obtained using the kneading and pulverizing method, are changed by mechanical shock or heat energy. Examples of wet methods include an emulsion polymerization aggregation method in which a dispersion obtained by emulsifying and polymerizing polymerizable monomers of a binder resin and optionally, a dispersion of a colorant, a release agent, a charge-controlling agent, and the like are mixed, aggregated, heated, and fused to obtain toner particles; a suspension polymerization method in which polymerizable monomers for obtaining a binder resin and optionally, a solution having a colorant, a release agent, a charge-controlling agent, and the like are suspended in an aqueous solvent and polymerized; and a dissolving suspension method in which a binder resin and optionally, a solution having a colorant and a release agent, a charge-controlling agent and the like are suspended in an aqueous solvent for granulation.

For example, the binder resin and the resin having an unsaturated double bond and optionally, the colorant, other additives, and the like are put into a mixing device such as a Henschel mixer and mixed. Then, the mixture is melt-kneaded in a twin screw extruder, a Banbury mixer, a roll mill, a kneader, or the like, cooled using a drum flaker or the like, coarsely pulverized using a pulverizer such as a hammer mill, finely pulverized using a pulverizer such as a jet mill, and classified using a wind classifier. As a result, a toner is obtained in the pulverizing method.

In addition, the binder resin and the resin having an unsaturated double bond and optionally, the colorant, other additives, and the like are dissolved in a solvent such as ethyl acetate, and emulsified and suspended in water to which a dispersion stabilizer such as calcium carbonate is added. After the solvent is removed, particles obtained by removing the dispersion stabilizer are filtrated and dried. As a result, a toner is obtained in the emulsifying-in-liquid-and-drying method.

In addition, when the toner is obtained, the mixing ratio of the respective materials (the binder resin, the colorant, other additives, and the like) may be set in consideration of required characteristics, a low-temperature fixing property, color and the like. The obtained toner is pulverized in carrier oil using a well-known pulverizer such as a ball mill, a bead mill, and a high-pressure wet atomizer. As a result, toner particles for liquid developer are obtained.

For example, the thiol compound, the polymerization initiator, and the radical polymerizable material are added to the toner thus obtained, followed by dispersion in a solvent such as alcohol (for example, methanol). Then, the solvent is removed through reduction in pressure and the like. As a result, a curable toner is obtained.

Properties of Toner

The volume average particle size D50v of the toner is preferably from 0.5 μm to 5.0 μm. In the above-described range, adhesion increases and developability is improved. In addition, the resolution of an image is also improved. The volume average particle size D50v of the toner is more preferably from 0.8 μm to 4.0 μm and still more preferably from 1.0 μm to 3.0 μm.

The volume average particle size 050v, the number average particle size distribution index (GSDp), the volume average particle size distribution index (GSDv), and the like of the toner are measured using a laser diffraction/scattering particle size distribution analyzer such as LA920 (manufactured by Horiba Ltd.). The cumulative distributions of particle sizes from a smaller particle size side in terms of volume and number are drawn in a particle size range (channel) which is divided based on the particle size distribution. A particle size which is an accumulated value of 16% is defined as Volume D16v and Number D16p, a particle size which is an accumulated value of 50% is defined as Volume D50v and Number D50p, and a particle size which is an accumulated value of 84% is defined as Volume D84v and Number D84p. Using these, the volume average particle size distribution index (GSDv) is calculated according to an expression of $(D84v/D16v)^{1/2}$ and the number average particle size distribution index (GSDp) is calculated according to an expression of $(D84p/D16p)^{1/2}$.

Liquid Developer

A liquid developer according to the exemplary embodiment includes the above-described toner and a carrier solution. In a liquid developer using a carrier solution such as non-volatile paraffin oil, the carrier solution remains in a fixed image. As a result, the carrier solution and the binder resin of the toner have affinity to each other, which is likely to lead to blocking. In the exemplary embodiment, it is considered that the toner includes the resin having an unsaturated double bond, the thiol compound having a bi- or more-functional thiol group, and the polymerization initiator; the unsaturated double bond of the resin having an unsaturated double bond and the thiol group of the thiol compound with low oxygen inhibition are polymerized by heat, light or the like for curing; and as a result, even in the atmosphere, an image is sufficiently cured and an image with satisfactory blocking resistance is obtained even in the presence of the carrier solution. Using an ene-thiol reaction, an image has less curing shrinkage and is sufficiently cured in the atmosphere.

Carrier Solution

The carrier solution is an insulating liquid for dispersing the toner and is not particularly limited. Examples thereof include aliphatic hydrocarbon solvents including an aliphatic hydrocarbon such as paraffin oil as the main component (Examples of commercial products thereof include MORESCO WHITE MT-30P, MORESCO WHITE P40, and MORESCO WHITE P70 (all of which are manufactured by MATSUMURA OIL Co., Ltd.) and ISOPAR L and ISOPAR M (both of which are manufactured by Exxon Mobil Corporation)); and hydrocarbon solvents such as naphthenic oil (Examples of commercial products thereof include EXXSOL D80, EXXSOL D110, and EXXSOL D130 (all of which are manufactured by Exxon Mobil Corporation) and NAPHTHESOL L, NAPHTHESOL M, NAPHTHESOL H, NEW NAPHTHESOL 160, NEW NAPHTHESOL 200, NEW NAPHTHESOL 220, and NEW NAPHTHESOL MS-20P (all of which are manufactured by Nippon Petro Chemicals Co., Ltd)). Among these, the aliphatic hydrocarbon solvents including an aliphatic hydrocarbon as the main component are preferable and solvents of linear or branched aliphatic hydrocarbon having 6 to 15 carbon atoms are more preferable, from the viewpoint that the initiator or the thiol compound in the toner is insoluble therein.

As the carrier solution included in the liquid developer according to the exemplary embodiment, the above examples may be used alone or in combination of two or more kinds. Examples of the combination of two or more kinds of the carrier solution include a mixture of a paraffin solvent and vegetable oil and a mixture of a silicone solvent and vegetable oil.

The volume resistivity of the carrier solution is, for example, from $1.0\times10^{10}$ Ω·cm to $1.0\times10^{14}$ Ω·cm and may be from $1.0\times10^{10}$ Ω·cm to $1.0\times10^{13}$ Ω·cm.

The carrier solution may include secondary materials such as a dispersant, an emulsifier, a surfactant, a stabilizer, a wetting agent, a thickener, a foaming agent, an antifoaming agent, a coagulant, a gelling agent, an anti-settling additive, a charge-controlling agent, an anti-static additive, an age resister, a softener, a plasticizer, a filler, an oderant, an anti-tack agent, a release agent, and a radical scavenger. In particular, it is preferable that the carrier solution include N-PAL, hydroquinone, or the like which is a radical scavenger, from the viewpoints of preservation stability and the like.

Preparation Method of Liquid Developer

The liquid developer according to the exemplary embodiment is obtained by mixing and pulverizing the toner and the carrier solution using a disperser such as a ball mill, a sand mill, an attritor, or a bead mill to disperse the toner in the carrier solution. A method of dispersing the toner in the carrier solution is not limited to the disperser. The dispersion may be performed by high-speed rotation of a special stirring blade as in the case of a mixer, shearing force of a rotor-stator known as a homogenizer, or ultrasonic waves.

The concentration of the toner in the carrier solution is preferably from 0.5% by weight to 40% by weight and more preferably from 1% by weight to 30% by weight, from the viewpoints of appropriate control of the viscosity of the developer and smooth circulation of the developer in a developing unit.

Then, the obtained dispersion may be filtrated using a filter such as a membrane filter with, for example, a pore size of about 100 μm to remove dirt, coarse particles, and the like.

Dry Developer

In the exemplary embodiment, a dry developer is not particularly limited as long as it includes the toner according to the exemplary embodiment, and the composition thereof may be appropriately selected according to the purpose. As the dry developer according to the exemplary embodiment, a single component developer in which only the toner is used or a two-component developer in which the toner is used in combination with a carrier may be used.

For example, when the toner is used in combination with a carrier, the carrier is not particularly limited, and well-known carriers such as resin-coated carriers which are disclosed in, for example, JP-A-62-39879 and JP-A-56-11461 may be used.

Specific examples of the carrier include the following resin-coated carriers. Examples of core particles of the carrier include well-known particles of iron powder, ferrite, and magnetite, and the volume average particle size thereof is approximately from 30 μm to 200 μm.

In addition, examples of a coating resin of the resin-coated carrier include homopolymers or copolymers of two or more monomers of styrenes such as styrene, parachlorostyrene, and α-methyl styrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acryls such as dimethylaminoethyl methacrylate; vinyl nitriles such as acrylonitrile and methacrylonitrile; vinyl pyridines such as 2-vinyl pyridine and 4-vinyl pyridine; vinyl ethers such as vinyl methyl ether and vinyl isobutyl ether; vinyl ketones such as vinyl methyl ketone, vinyl ethyl ketone, and vinyl isopropenyl ketone; olefins such as ethylene and propylene; and vinyl fluorine-containing monomers such as fluorinated vinylidene, tetrafluoroethylene, and hexafluoroethylene; silicone resins containing methyl silicone and methyl phenyl silicone, and the like; polyesters containing bisphenol, glycol, and the like; epoxy resins; polyurethane resins; polyamide resins; cellulose resins; polyether resins; and polycarbonate resins. These resins may be used alone or in combination of two or more kinds. The coating amount of the coating resin is preferably from 0.1 part by weight to 10 parts by weight and more preferably from 0.5 part by weight to 3.0 parts by weight, with respect to the 100 parts by weight of the core particles.

For the preparation of the carrier, a heating kneader, a heating Henschel mixer, a UM mixer, or the like may be used, and depending on the amount of the coating resin, a heating fluidized rolling bed, a heating kiln, and the like may be used.

The mixing ratio of the toner and the carrier according to the exemplary embodiment in the dry developer is not particularly limited and may be selected according to the purpose.

Developer Cartridge, Process Cartridge, and Image Forming Apparatus

For example, an image forming apparatus according to the exemplary embodiment include an image holding member (hereinafter, sometimes referred to as "the photoreceptor"); a charging unit that charges a surface of the image holding member; a latent image forming unit that forms a latent image on the surface of the image holding member; a developing unit that forms a toner image by developing the latent image, which is formed on the surface of the image holding member, using the liquid developer according to the exemplary embodiment, which is held on the surface of a developer holding member; a transfer unit that transfers the toner image, which is formed on the surface of the image holding member, onto a recording medium; a fixing unit that forms a fixed image by fixing the toner image, which is transferred onto the recording medium, on the recording medium; and a curing unit that cures the fixed image.

In the image forming apparatus, for example, a portion including the developing unit may have a cartridge structure (process cartridge) which is detachable from the image forming apparatus main body. This process cartridge is not particularly limited as long as it contains the liquid developer or the dry developer according to the exemplary embodiment. For example, the process cartridge contains the liquid developer or the dry developer according to the exemplary embodiment; includes the developing unit that forms a toner image by developing the latent image, which is formed on the surface of the image holding member, using the liquid developer or the dry developer; and is detachable from the image forming apparatus.

In addition, a developer cartridge according to the exemplary embodiment is not particularly limited as long as it contains the liquid developer or the dry developer according to the exemplary embodiment. For example, the developer cartridge contains the liquid developer or the dry developer according to the exemplary embodiment; includes the developing unit that forms a toner image by developing the latent image, which is formed on the surface of the image holding member, using the liquid developer or the dry developer; and is detachable from the image forming apparatus.

Hereinafter, an example of an image forming apparatus according to the exemplary embodiment using the liquid developer will be described with reference to the drawings.

FIG. 1 is a diagram schematically illustrating a configuration example of the image forming apparatus according to the exemplary embodiment. An image forming apparatus 100 includes a photoreceptor (image holding member) 10, a charging device (charging unit) 20, an exposure device (latent image forming unit) 12, a developing device (developing unit) 14, an intermediate transfer medium (transfer unit) 16, a cleaner (cleaning unit) 18, a transfer fixing roller (transfer unit and fixing unit) 28, and a curing device (curing unit) 32. The photoreceptor 10 has a cylindrical shape. In the outer circumference of the photoreceptor 10, the charging device 20, the exposure device 12, the developing device 14, the intermediate transfer medium 16, and the cleaner 18 are provided in this order.

Hereinafter, the operations of this image forming apparatus 100 will be described.

The charging device 20 charges the surface of the photoreceptor 10 to a predetermined potential (charging process). Then, the exposure device 12 exposes the charged surface to, for example, laser beams on the basis of image signals to form a latent image (an electrostatic latent image) (latent image forming process).

The developing device 14 includes a developing roller 14*a* and a developer container 14*b*. The developing roller 14*a* is provided such that a part thereof is dipped in the liquid developer 24 included in the developer container 14*b*. The liquid developer 24 includes the insulating carrier solution, the toner containing the binder resin and the charge-controlling agent.

The toner is dispersed in the liquid developer 24. Furthermore, for example, by continuously stirring the liquid developer 24 with a stirring member provided inside the developer container 14*b*, the variation of the toner concentration in the liquid developer 24 depending on positions is reduced. As a result, the liquid developer 24, in which the variation of toner concentration is reduced, is supplied to the developing roller 14*a* which rotates in a direction indicated by arrow A in the drawing.

The liquid developer 24 which is supplied to the developing roller 14*a* is transported to the photoreceptor 10 in a state where the supply amount is restricted to a certain amount by a restricting member; and is supplied to an electrostatic latent image at a position where the developing roller 14*a* and the photoreceptor 10 are close to (or in contact with) each other. As a result, the electrostatic latent image is developed to form a toner image 26 (developing process).

The developed toner image 26 is transported to the photoreceptor 10 which rotates in a direction indicated by arrow B in the drawing and transferred to a paper (recording medium) 30. However, in the exemplary embodiment, in order to improve the transfer efficiency of the toner image from the photoreceptor 10 to the recording medium including the separation efficiency from the photoreceptor 10 and furthermore to perform the transferring and fixing of the toner image onto the recording medium at the same time, the toner image is temporarily transferred onto the intermediate transfer medium 16 (intermediate transfer process). At this time, there may be the difference between the circumferential speeds of the photoreceptor 10 and the intermediate transfer medium 16.

Next, the toner image, which is transported by the intermediate transfer medium 16 in a direction indicated by arrow C, is transferred and fixed onto the paper 30 at a position in contact with the transfer and fixing roller 28 (transfer process and fixing process). The paper 30 is sandwiched between the transfer and fixing roller 28 and the intermediate transfer medium 16 such that the toner image on the intermediate transfer medium 16 is in close contact with the paper 30. Accordingly, the toner image is transferred onto the paper 30 and the toner image on the paper is fixed. As a result, a fixed image 29 is obtained. The transfer and fixing roller 28 is preferably provided with a heating element such that the toner image be fixed by pressure and heat. In general, the fixing temperature is from 120° C. to 200° C.

When the intermediate transfer medium 16 is a roller type as shown in FIG. 1, a roller pair is formed with the transfer and fixing roller 28. Therefore, the intermediate transfer medium 16 and the transfer and fixing roller 28 respectively correspond to a fixing roller and a pressing roller in a fixing device and thus fulfills a fixing function. That is, when the paper 30 passes through a nip portion formed between the intermediate transfer medium 16 and the transfer and fixing roller 28, the toner image is heated and pressed against the intermediate transfer medium 16 by the transfer and fixing roller 28 while being transferred onto the intermediate transfer medium 16. Accordingly, the binder resin in the toner which configures the toner image is softened and the toner image is infiltrated into fibers of the paper 30. As a result, the fixed image 29 is formed on the paper 30.

In the exemplary embodiment, the transferring and fixing of the toner image onto the recording medium 30 are performed at the same time. However, the fixing process may be performed after the transfer process independently of each other. In this case, the transfer roller which transfers the toner image from the photoreceptor 10 onto the recording medium has a function corresponding to that of the intermediate transfer medium 16.

Next, the fixed image is cured by the curing device 32 (curing process). Curing is performed by the irradiation of ultraviolet rays (UV) and electromagnetic waves such as electron beams when the toner includes the photopolymerization initiator; and is performed by heating or the like when the toner includes the thermal polymerization initiator. Examples of the curing device 32 include a UV irradiation device, an electron beam irradiation device, a roll heater, a belt heater, and an oven.

Meanwhile, in the photoreceptor 10 which transfers the toner image 26 onto the intermediate transfer medium 16, a toner which remains thereon without being transferred is transported to a position in contact with the cleaner 18 and recovered by the cleaner 18. When the transfer efficiency approaches 100% and there is no problem with a remaining toner, the cleaner 18 may not be provided.

The image forming apparatus 100 may include an erasing device (not shown) which erases the charge on the surface of the photoreceptor 10 after transferring and before subsequent charging.

All of the charging device 20, the exposure device 12, the developing device 14, the intermediate transfer medium 16, the transfer and fixing roller 28, the curing device 32, the cleaner 18, and the like which are included in the image forming apparatus 100, may operate in synchronization with the rotating speed of the photoreceptor 10.

When the dry developer is used, the developing unit has a function of forming the toner image by developing the electrostatic latent image, which is formed on the photoreceptor 10, using the single-component developer or two-component developer containing the toner. Such a developing device is not particularly limited as long as it has the above-described function, and may be selected depending on the purposes: a type in which a toner layer is in contact with the photoreceptor 10 or a type in which the toner layer is not in contact with the photoreceptor 10 may be selected. For example, well-known developer units such as a developer unit which has a function of attaching toner onto the photoreceptor 10 using a roller, a brush, or the like, are used.

The image forming apparatus according to the exemplary embodiment may include a transparent image forming unit that forms a transparent image on an image holding member, which includes a blanket, a transfer roller, and a transfer belt, using the toner according to the exemplary embodiment as a transparent toner; a color image forming unit that forms a color image (underlayer), which contains one or more color particles, on the transparent image; a transfer unit that transfers the formed images onto a recording medium; a fusing unit that fuses the transparent image on the recording medium; and a curing unit that cures the fused image by the irradiation of ultraviolet rays, heating, or the like.

It is considered that: the resin having an unsaturated double bond, the thiol compound having a bi- or more-functional thiol group, and the polymerization initiator are used; the unsaturated double bond of the resin having an unsaturated double bond and the thiol group of the thiol compound with low oxygen inhibition are polymerized by heat, light or the like for curing; and as a result, even in the atmosphere, an image is sufficiently cured and an image with satisfactory blocking resistance is obtained. Using an ene-thiol reaction, an image has less curing shrinkage and is sufficiently cured in the atmosphere.

EXAMPLES

Hereinafter, the exemplary embodiment will be described in detail with reference to Examples and Comparative Examples. However, the present invention is not limited to the following Examples.

Example 1

Preparation of Developer 40 parts by weight of cyan pigment C.I. Pigment Blue 15:3 (manufactured by Clariant Japan K.K.) as a colorant is added to 60 parts by weight of styrene-based thermoplastic resin (manufactured by FUJIKURA KASEI CO., LTD, trade name: FSR-051, weight average molecular weight: 390,000), followed by kneading with a pressure kneader. The kneaded matter is coarsely pulverized and a cyan pigment master batch is prepared.

Next, a mixture having the following composition is kneaded again using a pressure kneader.

The above-mentioned cyan pigment master batch: 25 parts by weight

Styrene-based thermoplastic resin (vinyl resin, manufactured by FUJIKURA KASEI CO., LTD, trade name: FSR-053, weight average molecular weight: 320,000): 55 parts by weight Styrene-based thermoplastic elastomer (resin having an unsaturated double bond, manufactured by Asahi Kasei Chemicals Corporation, trade name: ASAPRENE 7439, styrene-butadiene block copolymer, styrene:butadiene ratio (mole)=45:55): 20 parts by weight The kneaded matter is pulverized using a jet mill. As a result, Cyan particles 1 having a volume average particle size of 10 μm are obtained. A mixture of 103 parts by weight of refractory paraffin oil (nonaqueous solvent, manufactured by MATSUMURA OIL Co., Ltd., trade name: MORESCO WHITE MT-30P, linear and branched aliphatic hydrocarbons having 12 to 15 carbon atoms) and 0.7 part by weight of dispersant (manufactured by The Lubrizol Corporation, trade name: SOLSPERSE 20000) is added to 35 parts by weight of cyan particles thus obtained and the resultant is finely pulverized using a ball mill. 180 parts by weight of the above paraffin oil, 45 parts by weight of 40% by weight methanol solution of liquid thiol compound (manufactured by SHOWA DENKO K.K., trade name: KARENZ MTPE-1, tetrafunctional, pentaerythritol-based), and 10 parts by weight of 20% by weight methanol solution of photopolymerization initiator (IRGACURE 819, manufactured by BASF Japan Ltd.) are added thereto, followed by dispersion for 10 minutes using an ultrasonic cleaner (manufactured by AS ONE Corporation, Model No. US-3R) and the methanol is removed by reduction in pressure. As a result, Liquid developer A1 having toner particles with a volume average particle size of 1.3 μm is obtained.

Preparation of Evaluation Image

A carrier solution (paraffin oil, manufactured by MATSUMURA OIL Co., Ltd., trade name: MORESCO WHITE MT-30P) is added to the obtained liquid developer, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 100° C., a length of a contact portion of 6 mm, and a fixing speed of 126 mm/sec. As a result, a fixed image is obtained.

The surface of the fixed image is exposed to a metal halide lamp at 400 mJ/cm$^2$. As a result, Evaluation image A1 is obtained.

Example 2

Preparation of Developer

Liquid developer A2 is prepared in the same preparation method as that of Liquid developer A1 according to Example 1, except that 5.0 parts by weight of thermal polymerization initiator (manufactured by Wako Pure Chemical Industries, Ltd., Model No.: VF-601, 10-hour half-life temperature: 66° C.) is used instead of the photopolymerization initiator (IRGACURE 819, manufactured by BASF Japan Ltd.) used in Liquid developer A1 obtained in Example 1.

Preparation of Evaluation Image

A carrier solution (paraffin oil, manufactured by MATSUMURA OIL Co., Ltd., trade name: MORESCO WHITE MT-30P) is added to the obtained liquid developer, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 120° C., a length of a contact portion of 6 mm, and a fixing speed of 126 mm/sec. As a result, a fixed image and Evaluation image A2 are obtained.

Example 3

Preparation of Developer

Similar to the preparation method of Liquid developer A1 obtained in Example 1, a thiol compound (manufactured by SHOWA DENKO K.K., trade name: KARENZ MTNR-1, triazine-based) is used instead of the liquid thiol compound (manufactured by SHOWA DENKO K.K., trade name: KARENZ MTPE-1, tetrafunctional, pentaerythritol-based). Furthermore, 10 parts by weight of 30% by weight methanol solution of radical polymerizable material (manufactured by TOAGOSEI CO., LTD., trade name: ARONIX M-402, a compound of dipentaerythritol pentaacrylate and dipentaerythritol hexaacrylate, pentafunctional and hexafunctional) and 10 parts by weight of 20% by weight methanol solution of photopolymerization initiator (IRGACURE 819, manufactured by BASF Japan Ltd.) are added thereto, followed by dispersion for 10 minutes using an ultrasonic cleaner (manufactured by AS ONE Corporation, Model No. US-3R) and the methanol is removed by reduction in pressure. Liquid developer A3 having toner particles with a volume average particle size of 1.3 μm is obtained.

Preparation of Evaluation Image

A carrier solution (paraffin oil, manufactured by MATSUMURA OIL Co., Ltd., trade name: MORESCO WHITE MT-30P) is added to the obtained liquid developer, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 100° C., a length of a contact portion of 6 mm, and a fixing speed of 126 mm/sec. As a result, a fixed image is obtained.

Evaluation image A3 is obtained in the same preparation method as that of Evaluation image A1 according to Example 1.

Example 4

Preparation of Developer 4.0 parts by weight of thermal polymerization initiator (manufactured by Wako Pure Chemical Industries, Ltd., Model No.: VF-601, 10-hour half-life temperature: 66° C.) is added to Liquid developer A1 obtained in Example 1. As a result, Liquid developer A4 is prepared.

Preparation of Evaluation Image

A carrier solution (paraffin oil, manufactured by MATSUMURA OIL Co., Ltd., trade name: MORESCO WHITE MT-30P) is added to the obtained liquid developer, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 100° C., a length of a contact portion of 6 mm, and a fixing speed of 126 mm/sec. As a result, a fixed image is obtained.

The surface of the fixed image is exposed to a metal halide lamp at 400 mJ/cm$^2$. As a result, Evaluation image A4 is obtained.

Example 5

Preparation of Developer

Liquid developer A5-1 is prepared in the same preparation method as that of Liquid developer A1 according to Example 1, except that the thiol compound (manufactured by SHOWA DENKO K.K., trade name: KARENZ MTNR-1, trifunctional, triazine-based) is used instead of the liquid thiol compound (manufactured by SHOWA DENKO K.K., trade name: KARENZ MTPE-1, tetrafunctional) according to Example 1. Furthermore, 40 parts by weight of 30% by weight methanol solution of radical polymerizable material (manufactured by TOAGOSEI CO., LTD., trade name: ARONIX M-211B, a diacrylate compound of bisphenol A, bifunctional) is added to Liquid developer A5-1 obtained above, followed by dispersion for 10 minutes using an ultrasonic cleaner (manufactured by AS ONE Corporation, Model No. US-3R) and the methanol is removed by reduction in pressure. As a result, Liquid developer A5-2 having toner particles with a volume average particle size of 1.3 μm is obtained.

Preparation of Evaluation Image

A carrier solution (paraffin oil, manufactured by MATSUMURA OIL Co., Ltd., trade name: MORESCO WHITE MT-30P) is added to Liquid developer A5-2 thus obtained, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 100° C., a length of a contact portion of 6 mm, and a fixing speed of 126 mm/sec. As a result, a fixed image is obtained.

Evaluation image A5 is obtained in the same preparation method as that of Evaluation image A1 according to Example 1.

Example 6

Preparation of Developer

Liquid developer A6 is obtained in the same method as that of Example 1, except that the styrene-based thermoplastic elastomer (resin having an unsaturated double bond, manufactured by Asahi Kasei Chemicals Corporation, ASA- PRENE T439, styrene-butadiene block copolymer) is used instead of 55 parts by weight of styrene-based thermoplastic resin (vinyl resin, manufactured by FUJIKURA KASEI CO., LTD, trade name: FSR-053, weight average molecular weight: 320,000)

Preparation of Evaluation Image

Evaluation image A6 is obtained in the same preparation method as that of Evaluation image A1 according to Example 1.

Example 7

Preparation of Developer

Liquid developer A7 is prepared in the same preparation method as that of Liquid developer A5-2, except that the radical polymerization material according to Example 5 is not used.

Preparation of Evaluation Image

A carrier solution (paraffin oil, manufactured by MATSUMURA OIL Co., Ltd., trade name: MORESCO WHITE MT-30P) is added to Liquid developer A7 thus obtained, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 100° C., a length of a contact portion of 6 mm, and a fixing speed of 126 mm/sec. As a result, a fixed image is obtained.

Evaluation image A7 is obtained in the same preparation method as that of Evaluation image A1 according to Example 1.

Example 8

Preparation of Developer

Liquid developer A8 is prepared in the same preparation method as that of Liquid developer A1 according to Example 1, except that a thiol compound (manufactured by SHOWA DENKO K.K., trade name: KARENZ MTBD-1, bifunctional) is used instead of the liquid thiol compound according to Example 1 (manufactured by SHOWA DENKO K.K., trade name: KARENZ MTPE-1, tetrafunctional).

Preparation of Evaluation Image

A carrier solution (paraffin oil, manufactured by MATSUMURA OIL Co., Ltd., trade name: MORESCO WHITE MT-30P) is added to Liquid developer A8 thus obtained, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 100° C., a length of a contact portion of 6 mm, and a fixing speed of 126 mm/sec. As a result, a fixed image is obtained.

Evaluation image A8 is obtained in the same preparation method as that of Evaluation image A1 according to Example 1.

Comparative Example 1

Liquid developer B1 is prepared in the same preparation method as that of Example 1, except that the liquid thiol compound according to Example 1 (manufactured by SHOWA DENKO K.K., trade name: KARENZ MTPE-1, tetrafunctional) is not used.

Preparation of Evaluation Image

A carrier solution (paraffin oil, manufactured by MATSUMURA OIL Co., Ltd., trade name: MORESCO WHITE MT-30P) is added to the obtained liquid developer, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 100° C., a length of a contact portion of 6 mm, and a fixing speed of 126 mm/sec. As a result, a fixed image is obtained.

Preparation of Evaluation Image

Evaluation image B1 is obtained in the same preparation method as that of Evaluation image A1 according to Example 1.

Comparative Example 2

Liquid developer B2 is prepared in the same preparation method as that of Example 1, except that a hydrogen additive of a saturated styrene-butadiene block copolymer (manufactured by Asahi Kasei Chemical Corporation, trial model, L605) is used instead of the styrene-based thermoplastic elastomer (resin having an unsaturated double bond) according to Example 1.

Preparation of Evaluation Image

A carrier solution (paraffin oil, manufactured by MATSUMURA OIL Co., Ltd., trade name: MORESCO WHITE MT-30P) is added to the obtained liquid developer, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 100° C., a length of a contact portion of 6 mm, and a fixing speed of 126 mm/sec. As a result, a fixed image is obtained.

Evaluation image B2 is obtained in the same preparation method as that of Evaluation image A1 according to Example 1.

Comparative Example 3

Liquid developer B3 is prepared in the same preparation method as that of Example 2, except that the thermal polymerization initiator according to Example 2 is not used.

Preparation of Evaluation Image

A carrier solution (paraffin oil, manufactured by MATSUMURA OIL Co., Ltd., trade name: MORESCO WHITE MT-30P) is added to the obtained liquid developer, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 120° C., a length of a contact portion of 6 mm, and a fixing speed of 126 mm/sec. As a result, a fixed image and Evaluation image B3 are obtained.

Comparative Example 4

Preparation of Developer

Liquid developer B4 is prepared in the same preparation method as that of Liquid developer A1 of Example 1, except that a thiol compound (manufactured by TOKYO CHEMICAL INDUSTRY CO., LTD., trade name: 1-dodecanethiol, monofunctional) is used instead of the liquid thiol compound according to Example 1 (manufactured by SHOWA DENKO K.K., trade name: KARENZ MTPE-1, tetrafunctional).

Preparation of Evaluation Image

A carrier solution (paraffin oil, manufactured by MATSUMURA OIL Co., Ltd., trade name: MORESCO WHITE MT-30P) is added to Liquid developer B4 thus obtained, the resultant mixture is diluted such that the content of the toner particles is 2.5% by weight with respect to the total weight of the liquid developer, and the diluted mixture is put into a disposable cuvette (made of polystyrene). Two transparent electrodes facing each other with a 1 mm gap interposed therebetween are dipped into the disposable cuvette and a voltage of 300 V is applied thereto for 30 seconds. The electrodes are pulled up and toner particles deposited on the positive electrode are transferred onto an OHP sheet (manufactured by Fuji Xerox Co., Ltd., Model No.: V-516). The obtained transferred image is fixed by an external fixing device under conditions of a roller temperature of 100° C., a length of a contact portion of 6 mm, and a fixing speed of 126 mm/sec. As a result, a fixed image is obtained.

Evaluation image B4 is obtained in the same preparation method as that of Evaluation image A1 according to Example 1.

Evaluation

Blocking Resistance

The image surfaces of the obtained two evaluation images overlap each other and are left to stand for 1 week in an environment of a temperature of 60° C., a RH humidity of 50%, and a load of 500 g/cm$^2$. The overlapped images are peeled off from each other and whether or not there is any fusion between the images or any transfer to a non-image portion is visually inspected. The evaluation is conducted based on the following criteria. The evaluation results are shown in Table 1.

A: Level in which there is no image deterioration, peel-off sound, and the like as blocking resistance properties.

B: Level in which there is a peel-off sound but no image deterioration.

C: Level in which a small transfer between the images is found

D: Level in which a fusion or a transfer in the images is found and which is practically intolerable

TABLE 1

| | Material | | | | | |
|---|---|---|---|---|---|---|
| | Resin having Unsaturated Double Bond/Vinyl Resin | Thiol Compound | Polymerization Initiator | Radical Polymerizable Material | Carrier Solution | Evaluation Blocking Resistance |
| Example 1 | ASAPRENE T439/FSR-053 | KARENZ MTPE-1 | Photopolymerization Initiator | None | 30P | B |
| Example 2 | ASAPRENE T439/FSR-053 | KARENZ MTPE-1 | Thermal Polymerization Initiator | None | 30P | B |
| Example 3 | ASAPRENE T439/FSR-053 | KARENZ MTNR-1 | Photopolymerization Initiator | ARONIX M-402 | 30P | A |
| Example 4 | ASAPRENE T439/FSR-053 | KARENZ MTPE-1 | Photopolymerization Initiator Thermal Polymerization Initiator | None | 30P | A |
| Example 5 | ASAPRENE T439/FSR-053 | KARENZ MTNR-1 | Photopolymerization Initiator | ARONIX M-211B | 30P | A |
| Example 6 | ASAPRENE T439/None | KARENZ MTPE-1 | Photopolymerization Initiator | None | 30P | C |
| Example 7 | ASAPRENE T439/FSR-053 | KARENZ MTNR-1 | Photopolymerization Initiator | None | 30P | C |
| Example 8 | ASAPRENE T439/FSR-053 | KARENZ MTBD-1 | Photopolymerization Initiator | None | 30P | C |
| Comparative Example 1 | ASAPRENE T439/FSR-053 | None | Photopolymerization Initiator | None | 30P | D |
| Comparative Example 2 | S.O.E. L605/FSR-053 | KARENZ MTPE-1 | Photopolymerization Initiator | None | 30P | D |
| Comparative Example 3 | ASAPRENE T439/FSR-053 | KARENZ MTPE-1 | None | None | 30P | D |
| Comparative Example 4 | ASAPRENE T439/FSR-053 | 1-dodecanethiol | Photopolymerization Initiator | None | 30P | D |

Preparation of Underlayer Liquid Developer 40 parts by weight of black pigment (manufactured by Mitsubishi Chemical Corporation) is added to 60 parts by weight of styrene-based thermoplastic resin (manufactured by FUJIKURA KASEI CO., LTD, styrene-acrylic ester resin, weight average molecular weight: 190,000), followed by kneading with a pressure kneader. The kneaded matter is coarsely pulverized and a black pigment master batch is prepared.

Next, a mixture having the following composition is kneaded again using a pressure kneader.

The above-mentioned black pigment master batch: 25 parts by weight

Styrene-based thermoplastic resin (manufactured by FUJIKURA KASEI CO., LTD, styrene-butyl acrylate resin, weight average molecular weight: 270,000): 55 parts by weight Thermoplastic elastomer (manufactured by Asahi Kasei Chemicals Corporation, L605, a hydrogen additive of a styrene-butadiene block copolymer): 20 parts by weight The kneaded matter is pulverized using a jet mill. As a result, black particles having a volume average particle size of 10 μm are obtained. 85 parts by weight of paraffin oil (manufactured by MATSUMURA OIL Co., Ltd., trade name: MORESCO WHITE 240) is added to 15 parts by weight of black particles and the resultant mixture is finely pulverized using a ball mill to have a volume average particle size of 2.5 μm. Furthermore, 0.001 part by weight of charge-controlling agent (disclosed in Compound preparation example 1 of JP-B-6-23865) is added thereto. As a result, an underlayer liquid developer is obtained.

Example 9

Preparation of Dry Developer 92 parts by weight of styrene-based thermoplastic resin (manufactured by FUJIKURA KASEI CO., LTD., styrene-acrylic ester resin, weight average molecular weight: 220,000), 23 parts by weight of ASAPRENE T439 (resin having an unsaturated double bond, manufactured by Asahi Kasei Chemicals Corporation), and 230 parts by weight of ethyl acetate are put into a ball mill and rotated for 1 day. As a result, Dispersion A9 is obtained. Meanwhile, 40 parts by weight of LUMINUS (manufactured by MARUO CALCIUM CO., LTD.) and 60 parts by weight of pure water are put into a ball mill and rotated for 3 days. As a result, Dispersion stabilizer A9 is obtained.

200 parts by weight of ion exchange water, 90 parts by weight of Dispersion stabilizer A9, and 40 parts by weight of sodium chloride (manufactured by Wako Pure Chemical Industries Ltd.) are put into a 1 L separable flask and stirred with a HIGH-FLEX HOMOGENIZER (manufactured by IKA Japan K.K., ULTRA-TURRAX T25) at 2,200 rpm for 1 minute. Then, 170 parts by weight of Dispersion A9 is added thereto, followed by stirring and emulsification at 8,800 rpm for 1 minute. As a result, a suspension is obtained.

The suspension is put into a 1 L separable flask which is equipped with a stirring device, a thermometer, a cooling pipe, and a nitrogen gas inlet pipe, followed by stirring at 60° C. for 4 hours while nitrogen gas is introduced through the nitrogen gas inlet pipe and ethyl acetate is removed. Then, cooling is performed and an aqueous 10% hydrochloric acid solution is added to the reaction solution to degrade calcium carbonate, followed by solid-liquid separation through suction filtration. The obtained particles are washed with 1 L of ion exchange water three times. As a result, particles are obtained. These particles are classified through a 10 μm mesh using 2 L of ion exchange water and particles are extracted by centrifugal separation. These particles are vacuum-dried at 40° C. As a result, Transparent toner A9 with a volume average particle size of 5.5 μm is obtained.

5 parts by weight of liquid thiol compound (manufactured by SHOWA DENKO K.K., trade name: KARENZ MTPE-1, 20% by weight methanol solution) and 20 parts by weight of 2% by weight methanol solution of photopolymerization initiator (manufactured by BASF Japan Ltd., IRGACURE 819) are added to Transparent toner A9 obtained above, followed by dispersion for 10 minutes using an ultrasonic cleaner (manufactured by AS ONE Corporation, Model No. US-3R) and the methanol is removed by reduction in pressure. As a result, Curable transparent toner A9 is obtained.

Example 10

Paraffin oil (manufactured by MATSUMURA OIL Co., Ltd., trade name: MORESCO WHITE MT-30P, linear aliphatic hydrocarbon having 12 to 15 carbon atoms) is added to Transparent toner A9 obtained in Example 9 such that the solid content concentration is 10% by weight. Then, the thiol compound and the photopolymerization initiator are added thereto in the same method as that of Example 1. As a result, Liquid developer A10 is obtained.

Example 11

Liquid developer A11 is obtained in the same preparation method as that of Liquid developer A10 according to Example 10, except that, as a carge-controlling agent, 0.001 part by weight of charge-controlling agent disclosed in Compound preparation example 1 of JP-B-6-23865 is added to Liquid developer A10 obtained in Example 10.

Example 12

Liquid developer A12 is obtained in the same preparation method as that of Liquid developer A10 according to Example 10, except that 20 parts of TUFPRENE A (manufactured by Asahi Kasei Chemical Corporation, styrene-butadiene block copolymer, styrene:butadiene ratio (mole)=40:60) is used instead of ASAPRENE T439 (resin having an unsaturated double bond according to Example 10).

Example 13

5 parts by weight of liquid thiol compound (manufactured by SHOWA DENKO K.K., trade name: KARENZ MTPE-1, 20% by weight methanol solution), 20 parts by weight of 2% by weight methanol solution of photopolymerization initiator (manufactured by BASF Japan Ltd., trade name: IRGACURE 819), and 10 parts by weight of 30% by weight methanol solution of radical polymerizable material (manufactured by TOAGOSEI CO., LTD., trade name: ARONIX M-402, a compound of dipentaerythritol pentaacrylate and dipentaerythritol hexaacrylate, pentafunctional and hexafunctional) are added to Transparent toner A9 obtained in Example 9, followed by dispersion for 10 minutes using an ultrasonic cleaner (manufactured by AS ONE Corporation, Model No. US-3R) and the methanol is removed by reduction in pressure. As a result, Curable transparent toner A13 is obtained.

Comparative Example 5

20 parts by weight of 2% by weight methanol solution of photopolymerization initiator (manufactured by BASF Japan Ltd., trade name: IRGACURE 819) is added to Transparent toner A9 obtained in Example 9, followed by dispersion for 10 minutes using an ultrasonic cleaner (manufactured by AS ONE Corporation, Model No. US-3R) and the methanol is removed by reduction in pressure. As a result, Transparent toner B5 is obtained.

Comparative Example 6

Paraffin oil (manufactured by MATSUMURA OIL Co., Ltd., trade name: MORESCO WHITE P70) is added to Transparent toner A9 obtained in Example 9 such that the solid content concentration is 10% by weight. Then, 20 parts by weight of 2% by weight methanol solution of photopolymerization initiator (manufactured by BASF Japan Ltd., trade name: IRGACURE 819) is added thereto, followed by dispersion for 10 minutes using an ultrasonic cleaner (manufactured by AS ONE Corporation, Model No. US-3R) and the methanol is removed by reduction in pressure. As a result, Liquid developer B6 is obtained.

Comparative Example 7

100 parts by weight of styrene-based thermoplastic resin (manufactured by FUJIKURA KASEI CO., LTD., styrene-acrylic ester resin, weight average molecular weight: 220,000) and 230 parts by weight of ethyl acetate are put into a ball mill and rotated for 1 day. As a result, Dispersion B7 is obtained. Meanwhile, 40 parts by weight of LUMINUS (manufactured by MARUO CALCIUM CO., LTD.) and 60 parts by weight of pure water are put into a ball mill and rotated for 3 days. As a result, Dispersion stabilizer B7 is obtained.

200 parts by weight of ion exchange water, 90 parts by weight of Dispersion stabilizer B7, and 40 parts by weight of sodium chloride (manufactured by Wako Pure Chemical Industries Ltd.) are put into a 1 L separable flask and stirred with a HIGH-FLEX HOMOGENIZER (manufactured by IKA Japan K.K., ULTRA-TURRAX T25) at 2,200 rpm for 1 minute. Then, 170 parts by weight of Dispersion B7 is added thereto, followed by stirring and emulsification at 8,800 rpm for 1 minute. As a result, a suspension is obtained.

The suspension is put into a 1 L separable flask which is equipped with a cooling pipe and a nitrogen gas inlet pipe, followed by stirring at 60° C. for 4 hours while nitrogen gas is introduced through the nitrogen gas inlet pipe and ethyl acetate is removed. Then, cooling is performed and an aqueous 10% hydrochloric acid solution is added to the reaction solution to degrade calcium carbonate, followed by solid-liquid separation through suction filtration. The obtained particles are washed with 1 L of ion exchange water three times. As a result, particles are obtained. These particles are classified through a 10 μm mesh using 2 L of ion exchange water and particles are extracted by centrifugal separation. These particles are vacuum-dried at 40° C. As a result, Transparent toner B7 with a volume average particle size of 5.3 μm is obtained.

Paraffin oil (manufactured by MATSUMURA OIL Co., Ltd., trade name: MORESCO WHITE P70) is added to Transparent toner B7 such that the solid content concentration is 10% by weight. Then, 5 parts by weight of liquid thiol compound (manufactured by SHOWA DENKO K.K., trade name: KARENZ MTPE-1, 20% by weight methanol solution) and 20 parts by weight of 2% by weight methanol solution of photopolymerization initiator (manufactured by BASF Japan Ltd., trade name: IRGACURE 819) are added thereto, followed by dispersion for 10 minutes using an ultrasonic cleaner (manufactured by AS ONE Corporation, Model No. US-3R) and the methanol is removed by reduction in pressure. As a result, Liquid developer B7 is obtained.

Image Formation

A carrier solution (paraffin oil, manufactured by MATSUMURA OIL Co., Ltd., trade name: MORESCO WHITE MT-30P) is added to the obtained underlayer liquid developer and the resultant mixture is diluted such that the content of the toner particles is 2.5% by weight with respect to the total weight of the liquid developer. Then, a 3.5 cm×3.5 cm toner image (amount of toner particles deposited: 4 g/m$^2$) is formed on a membrane filter (manufactured by Millipore Corporation) under reduced pressure and pressure-transferred onto OKTC127+ (manufactured by Oji paper Co., Ltd.). As a result, a black underlayer image is obtained. Next, a carrier solution (paraffin oil, manufactured by MATSUMURA OIL Co., Ltd., trade name: MORESCO WHITE MT-30P) is independently added to Liquid developers A9, A10, A11, A12, and A13 of Examples 9, 10, 11, 12, and 13 and the resultant mixture is diluted such that the content of the toner particles is 2.5% by weight with respect to the total weight of the liquid developer. Then, 3.5 cm×3.5 cm toner images (amount of toner particles deposited: 4 g/m$^2$) are formed on a membrane filter (manufactured by Millipore Corporation) under reduced pressure. These images are arranged so as to overlap each other on the black underlayer image. The images are pressure-transferred, the membrane filter is removed, and a transparent toner is layered on the black toner. Fixing is performed at 126 mm/s under conditions of a roll temperature of 150° C., a nip of 6 mm, an ultraviolet ray irradiation intensity of 6.4 mW/cm$^2$, and an ultraviolet ray irradiation time of 30 seconds (that is, an ultraviolet ray irradiation energy of 192 mJ/cm$^2$).

Evaluation

Blocking Resistance

The image surfaces of the obtained two evaluation images overlap each other and are left to stand for 3 days in an environment of a temperature of 60° C., a RH humidity of 50%, and a load of 500 g/cm$^2$. The overlapped images are peeled off from each other and whether or not there is any fusion between the images or any transfer to a non-image portion is visually inspected. The evaluation is conducted based on the following criteria. The evaluation results are shown in Table 2.

A: Level in which there is no image deterioration, peel-off sound, and the like as blocking resistance properties.

B: Level in which there is a peel-off sound but no image deterioration.

C: Level in which a small transfer between the images is found

D: Level in which a fusion or a transfer in the images is found and which is practically intolerable

TABLE 2

| | Material | | | | | | | Evaluation | |
|---|---|---|---|---|---|---|---|---|---|
| | Resin having Unsaturated Double Bond/Vinyl Resin | Thiol Compound | Polymerization Initiator | Radical Polymerizable Material | Charge-controlling agent | Carrier Solution | Thermal Fusion | Blocking Resistance | Cured Portion |
| Example 9 | ASAPRENE T439 | KARENZ MTPE-1 | Photopolymerization Initiator | None | None | None | Present | A | Entire Surface |
| Example 10 | ASAPRENE T439 | KARENZ MTPE-1 | Photopolymerization Initiator | None | None | 30P | None | B | Entire Surface |

TABLE 2-continued

| | Material | | | | | | | Evaluation | |
|---|---|---|---|---|---|---|---|---|---|
| | Resin having Unsaturated Double Bond/Vinyl Resin | Thiol Compound | Polymerization Initiator | Radical Polymerizable Material | Charge-controlling agent | Carrier Solu-tion | Thermal Fusion | Blocking Resist-ance | Cured Portion |
| Example 11 | ASAPRENE T439 | KARENZ MTPE-1 | Photopolymerization Initiator | None | Present | 30P | None | B | Only Image Portion |
| Example 12 | TUFPRENE A | KARENZ MTPE-1 | Photopolymerization Initiator | None | Present | 30P | Present | A | Only Image Portion |
| Example 13 | ASAPRENE T439 | KARENZ MTPE-1 | Photopolymerization Initiator | ARONIX M-402 | None | None | Present | A | Entire Surface |
| Comparative Example 5 | ASAPRENE T439 | None | Photopolymerization Initiator | None | None | None | Present | D | Insufficient Curing |
| Comparative Example 6 | ASAPRENE T439 | None | Photopolymerization Initiator | None | None | P70 | Present | D | Insufficient Curing |
| Comparative Example 7 | None (Styrene-Based Thermoplastic Resin) | KARENZ MTPE-1 | Photopolymerization Initiator | None | None | P70 | Present | D | Insufficient Curing |

As described above, according to the Examples, an image with superior blocking resistance to those of the Comparative examples is formed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner comprising:

a resin having an unsaturated double bond;

a thiol compound comprising a bi- or more-functional thiol group; and a polymerization initiator.

2. The toner according to claim 1, further comprising a vinyl resin.

3. The toner according to claim 1, further comprising a radical polymerizable material.

4. A liquid developer comprising:

the toner according to claim 1; and a carrier solution.

5. A dry developer comprising the toner according to claim 1.

6. A developer cartridge containing the liquid developer according to claim 4.

7. A developer cartridge containing the dry developer according to claim 5.

8. A process cartridge containing the liquid developer according to claim 4.

9. A process cartridge containing the dry developer according to claim 5.

10. An image forming apparatus comprising:

an image holding member;

a latent image forming unit that forms a latent image on a surface of the image holding member;

a developing unit that forms a toner image by developing the latent image, which is formed on the surface of the image holding member, using the liquid developer according to claim 4;

a transfer unit that transfers the toner image, which is formed on the surface of the image holding member, onto a recording medium;

a fixing unit that forms a fixed image by fixing the toner image, which is transferred onto the recording medium, on the recording medium; and a curing unit that cures the fixed image.

11. An image forming apparatus comprising:

an image holding member;

a latent image forming unit that forms a latent image on a surface of the image holding member;

a developing unit that forms a toner image by developing the latent image, which is formed on the surface of the image holding member, using the dry developer according to claim 5;

a transfer unit that transfers the toner image, which is formed on the surface of the image holding member, onto a recording medium;

a fixing unit that forms a fixed image by fixing the toner image, which is transferred onto the recording medium, on the recording medium; and a curing unit that cures the fixed image.

12. An image forming method comprising:

forming a latent image on a surface of an image holding member;

forming a toner image by developing the latent image, which is formed on the surface of the image holding member, using the liquid developer according to claim 4;

transferring the toner image, which is formed on the surface of the image holding member, onto a recording medium;

forming a fixed image by fixing the toner image, which is transferred onto the recording medium, on the recording medium; and curing the fixed image.

13. An image forming method comprising:

forming a latent image on a surface of an image holding member;

forming a toner image by developing the latent image, which is formed on the surface of the image holding member, using the dry developer according to claim 5;

transferring the toner image, which is formed on the surface of the image holding member, onto a recording medium;

forming a fixed image by fixing the toner image, which is transferred onto the recording medium, on the recording medium; and curing the fixed image.

* * * * *